US010364091B2

(12) United States Patent
Bodet et al.

(10) Patent No.: US 10,364,091 B2
(45) Date of Patent: Jul. 30, 2019

(54) DISPENSING HEAD FOR AEROSOL CONTAINER PROVIDED WITH BLOCKING MEANS

(71) Applicant: LINDAL FRANCE SAS, Briey (FR)

(72) Inventors: Hervé Bodet, Verdun (FR); Jérôme Peltier, Batilly (FR)

(73) Assignee: LINDAL FRANCE SAS, Briey (FR)

( * ) Notice: Subject to any disclaimer, the term of this patent is extended or adjusted under 35 U.S.C. 154(b) by 0 days.

(21) Appl. No.: 15/568,863

(22) PCT Filed: Apr. 22, 2016

(86) PCT No.: PCT/EP2016/059100

§ 371 (c)(1),
(2) Date: Oct. 24, 2017

(87) PCT Pub. No.: WO2016/170169

PCT Pub. Date: Oct. 27, 2016

(65) Prior Publication Data

US 2018/0118444 A1 May 3, 2018

(30) Foreign Application Priority Data

Apr. 24, 2015 (FR) ..... 15 53681

(51) Int. Cl.
*B65D 83/22* (2006.01)
*B65D 83/20* (2006.01)

(52) U.S. Cl.
CPC ..... *B65D 83/22* (2013.01); *B65D 83/205* (2013.01)

(58) Field of Classification Search
CPC ..... B65D 83/22; B65D 83/205
See application file for complete search history.

(56) References Cited

U.S. PATENT DOCUMENTS 4,024,988 A * 5/1977 Starrett ..... B65D 50/06 222/153.11
2007/0235474 A1* 10/2007 Downey ..... B65D 83/205 222/153.11

(Continued)

FOREIGN PATENT DOCUMENTS

FR 2 692 559 A1 12/1993
KR 10-2011-0128672 A 11/2011

OTHER PUBLICATIONS

International Search Report and Written Opinion dated Jul. 5, 2016 issued in corresponding application No. PCT/EP2016/059100; w/ English partial translation and partial machine translation (15 pages).

*Primary Examiner* — J C Jacyna
(74) *Attorney, Agent, or Firm* — Westerman, Hattori, Daniels & Adrian, LLP

(57) ABSTRACT

The invention relates to a dispensing head for an aerosol container provided with a valve. The dispensing head is made up of a cover (2) to which an actuating member (1) is secured, provided with a push button (11) which can be moved between a non-depressed rest position and a depressed actuating position. According to the invention, the actuating member (1) is provided with a blocking element (12) which can pivot between an unlocked position in which said element does not block the movement of the push button (11) relative to the cover (2) and a locked position in which said element blocks the push button in the rest position by preventing said push button from entering the actuating position.

23 Claims, 7 Drawing Sheets

(56) References Cited

U.S. PATENT DOCUMENTS

Figure 1A:
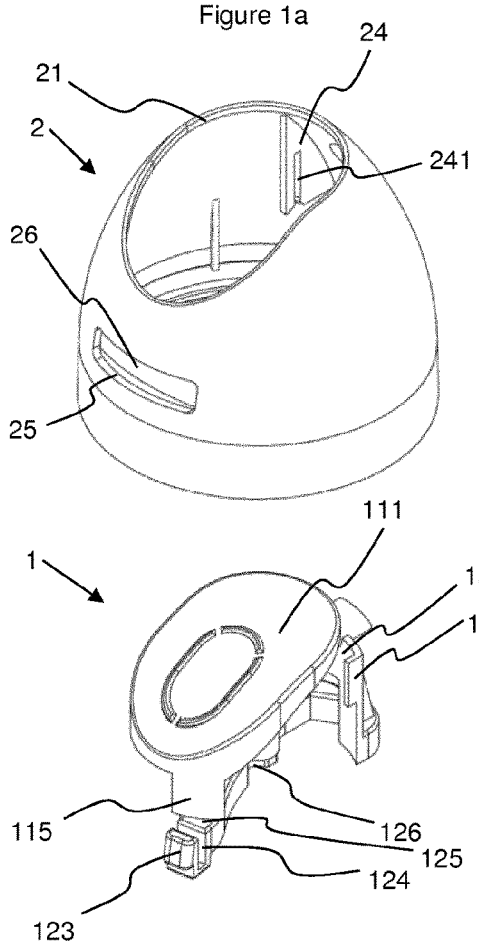

| | | | | |
|---|---|---|---|---|
| 2009/0145928 | A1 | 6/2009 | De Laforcade | |
| 2015/0375921 | A1* | 12/2015 | Sell | B65D 83/22 222/153.11 |
| 2016/0325916 | A1* | 11/2016 | Jasper | B05B 1/1636 |
| 2017/0001208 | A1* | 1/2017 | Barenhoff | B05B 11/0032 |

* cited by examiner

DISPENSING HEAD FOR AEROSOL CONTAINER PROVIDED WITH BLOCKING MEANS

The invention relates to a dispensing head for an aerosol container provided with a valve. The dispensing head is constituted by a cover on which is fixed an actuating member provided with a push button that can be moved between a non-depressed rest position and a depressed actuating position. The valve is either a female valve or a male valve. In the case of female valves, the dispensing head is provided with a dispensing rod (stem) which penetrates the valve to actuate it. On the contrary, in the case of male valves, the dispensing rod is an integral part of the valve.

In accordance with the invention, the actuating member is provided with a blocking element pivotable about an axis of rotation between an unlocked position in which it does not block the movement of the push button relative to the cover and a locked position in which it blocks the push button in the rest position by preventing it from going into the actuating position.

In a first variant embodiment, the push button is provided with an outlet conduit for the product to be removed, the first end of the outlet conduit being provided with connecting means intended to cooperate with the valve of an aerosol container, and the second end of the outlet conduit being intended to spray the product into the environment. The blocking element, in the blocked position, cooperates with a blocking portion of the first end of the outlet conduit.

In the case of male valves, the connecting means are constituted by an end-piece designed to cooperate with the rod of a male valve, the blocking element acting on the free end of the end-piece in the locked position. In the case of female valves, the connecting means are constituted by a rod designed to cooperate with a female valve, the first end of the outlet conduit being provided, on its outside face, with a shoulder designed so that the blocking element acts on this shoulder in the locked position.

In a second variant embodiment, the push button is provided with a rib parallel to the displacement movement of the push button between the rest position and the actuating position. In addition, the blocking element is provided with a bearing surface which, in the unlocked position, is not in the path followed by the rib when the push button is displaced from the rest position to the actuating position, and which, in the locked position, is in the said path so that the rib comes to abut against the bearing surface when the push button is moved in the direction of the actuating position, without being able to reach this position. The rib may be placed on the inner face of the push button, preferably radially relative to the axis of rotation. The rib may also be placed in alignment with the edge of the push button.

In a third variant embodiment, the pivoting portion has a notch surrounded by a cylinder portion directed toward the push button. In addition, the push button has on its lower face a blocking rib parallel to the displacement movement of the push button between the rest position and the actuating position, the height of the cylinder portion being chosen so that, in the locked position, the upper edge of the cylinder portion is in contact, or almost in contact, with the lower edge of the blocking rib so that the push button cannot go from the rest position to the actuating position. By "almost in contact", it should be understood that there is clearance between the top of the cylinder portion and the blocking rib, which clearance can even leave the possibility of moving the push button in the direction of the actuating position, but only to a very small extent, so that this displacement is too short to actuate the valve.

The blocking element can be constituted by a pivoting part articulated on the actuating member by means of a joint. The pivoting part can be provided with a control element accessible from the outside of the cover and a blocking surface provided with an arc-shaped notch, the dimensions of which are sufficient to allow the rod used to actuate the valve to pass through, but not the blocking portion of the first end of the outlet conduit.

The blocking surface of the blocking element can be surrounded by a cylinder portion dimensioned so that the pivoting part cannot pivot beyond the locked position.

In one embodiment of the invention, the cover is provided with a slot facing which the control element is located whatever the pivoting position of the pivoting portion between the unlocked position and the locked position, the control element being accessible from the outside through this slot. It is then preferable to provide a plate facing the slot in order to hide the inside of the cover from the user.

The control element is then placed between the slot and the plate. The plate may be placed in the cover, in which case the pivoting part may be provided with a groove whose width is at least equal to the thickness of the plate and in which the free end of the said plate is placed. It is also possible to place the plate on the pivoting portion between the slot and the control element, so that the plate is positioned facing the opening whatever the pivoting position of the pivoting portion.

Figure 1B:
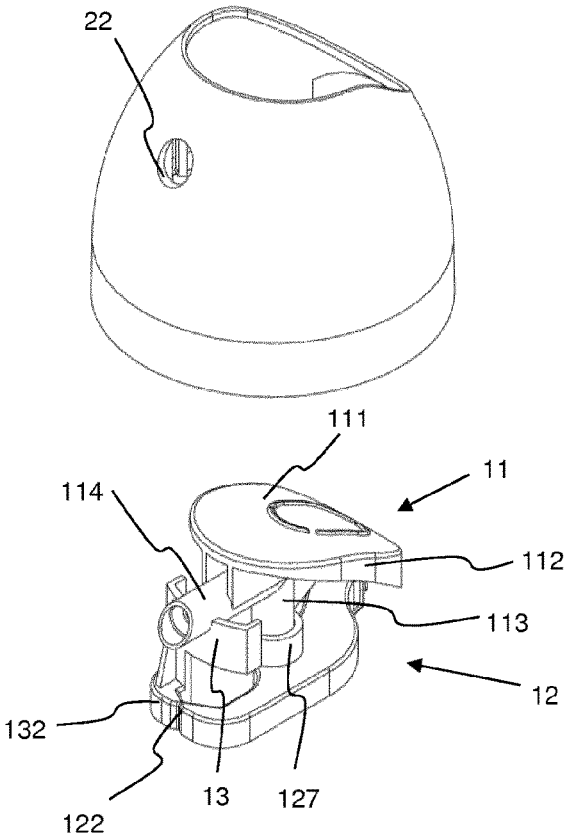
Figure 2:
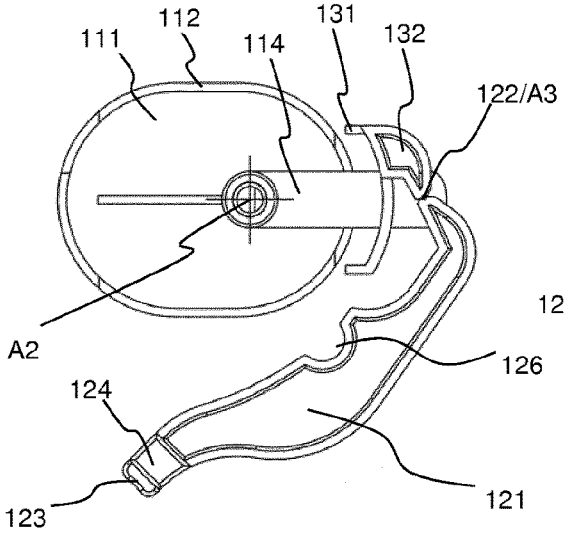
Figure 12:
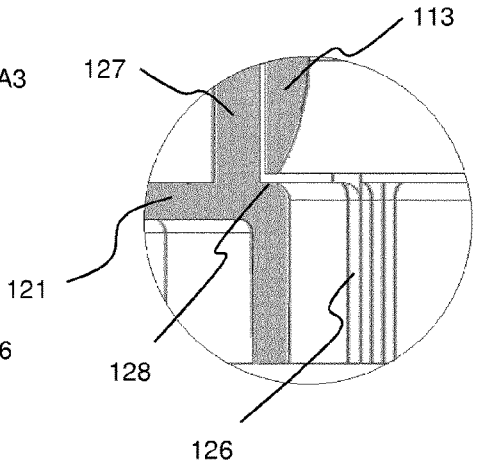
Figure 3A:
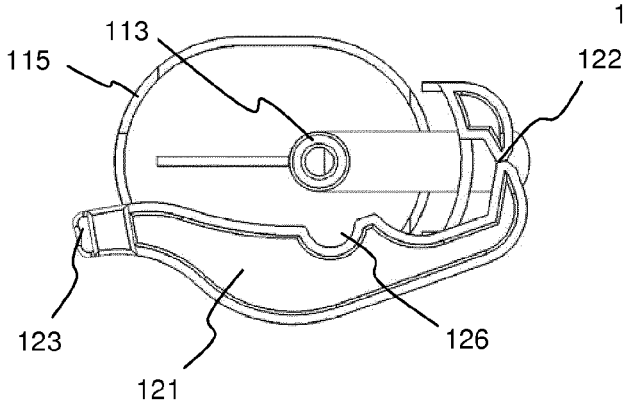
Figure 3B:
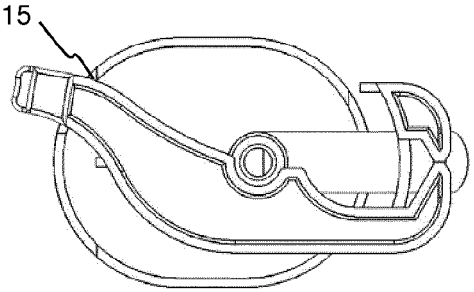
Figure 4A:
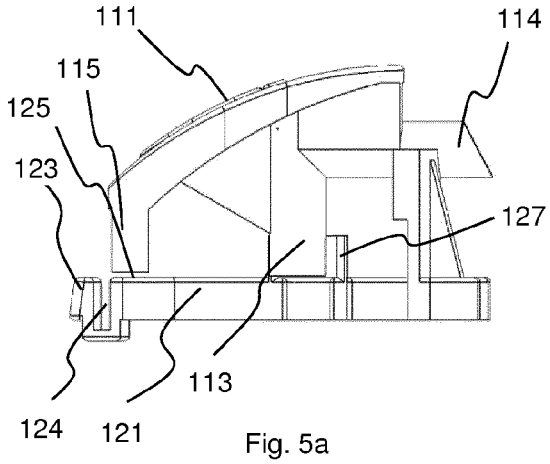
Figure 4B:
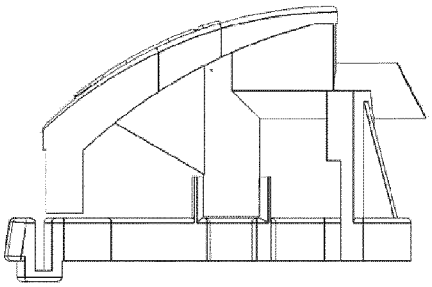
Figure 5A:
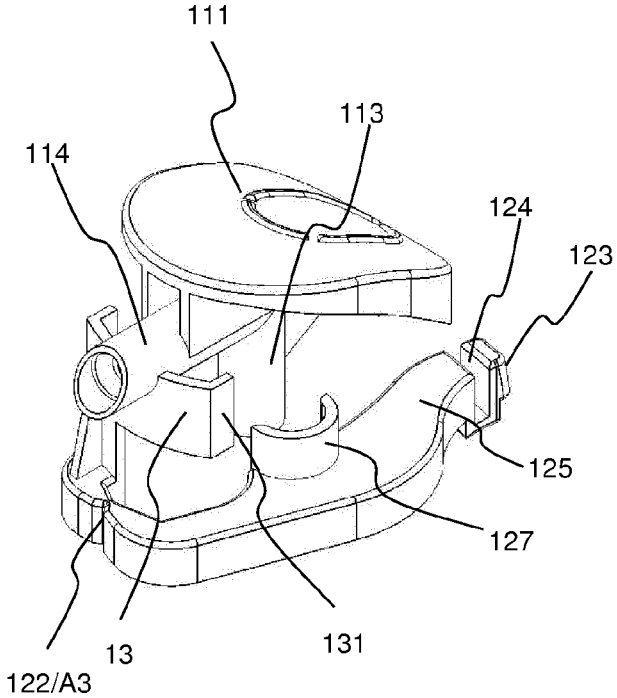
Figure 5B:
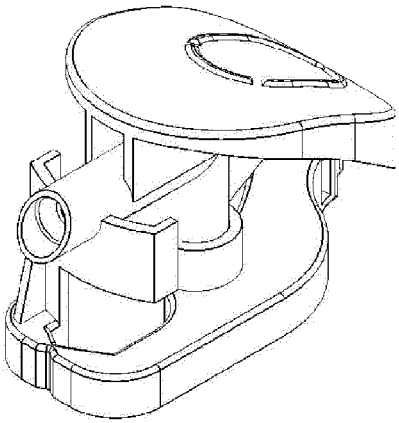
Figure 6:
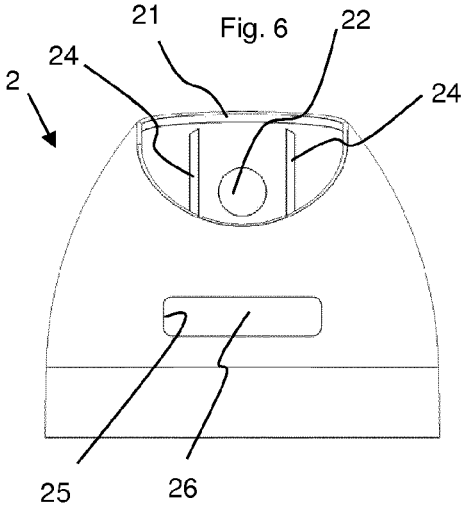
Figure 7:
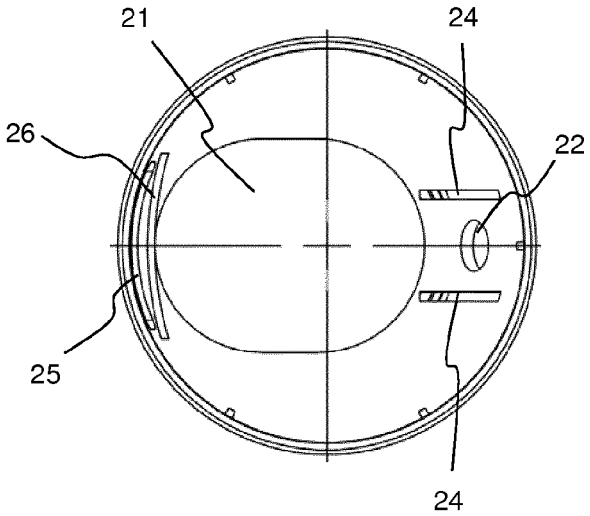
Figure 8:
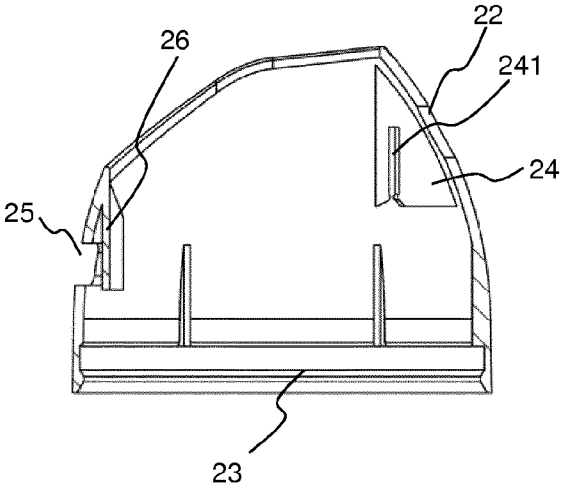
Figure 9:
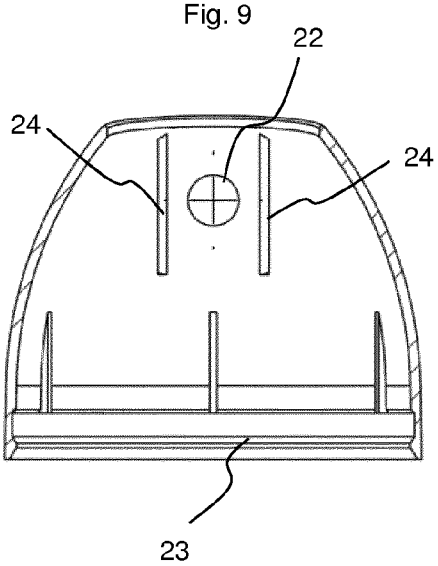
Figure 10A:
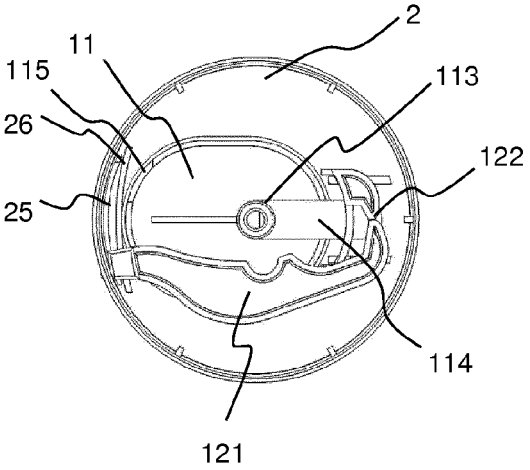
Figure 10B:
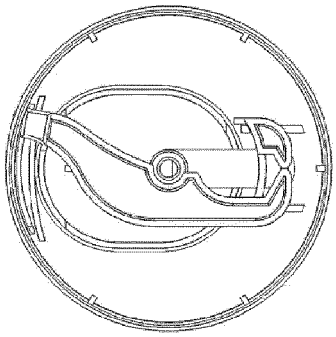
Figure 13A:
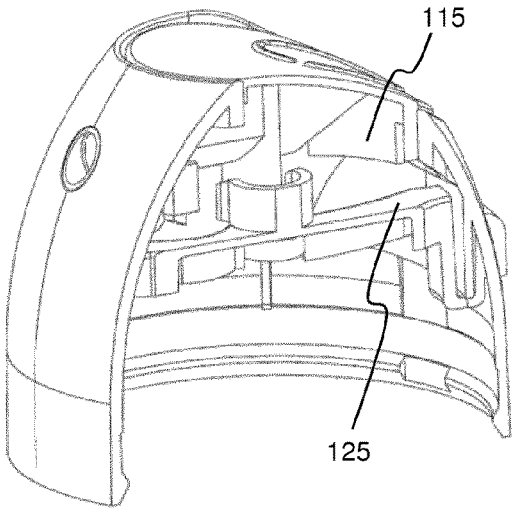
Figure 14A:
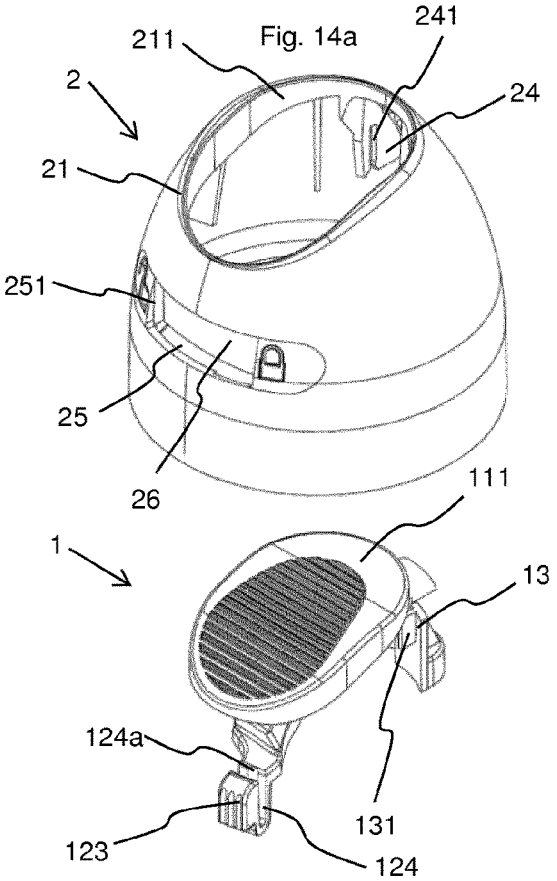
Figure 14B:
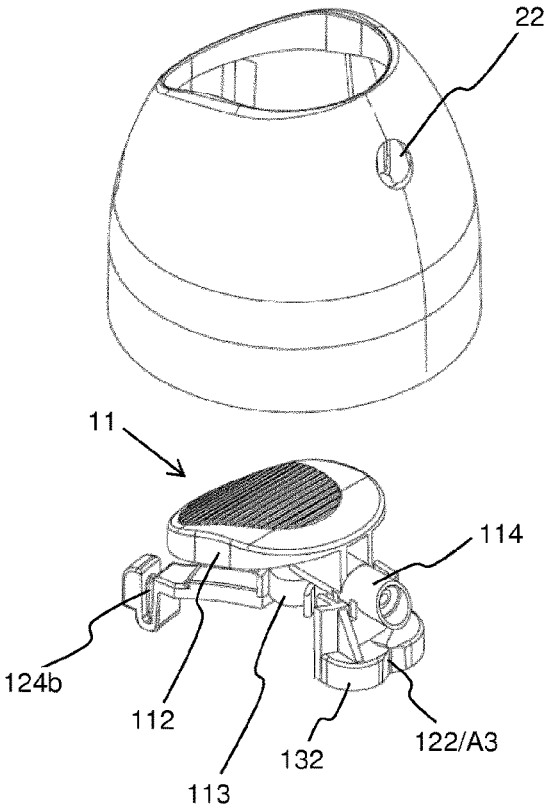
Figure 15A:
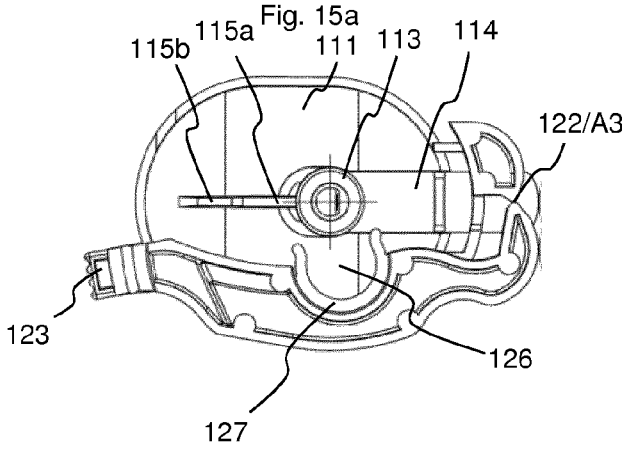
Figure 15B:
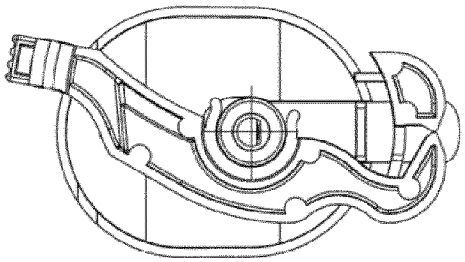
Figure 16A:
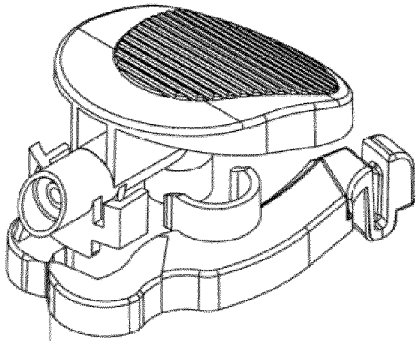
Figure 16B:
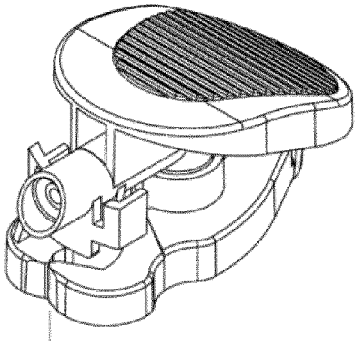
Figure 17A:
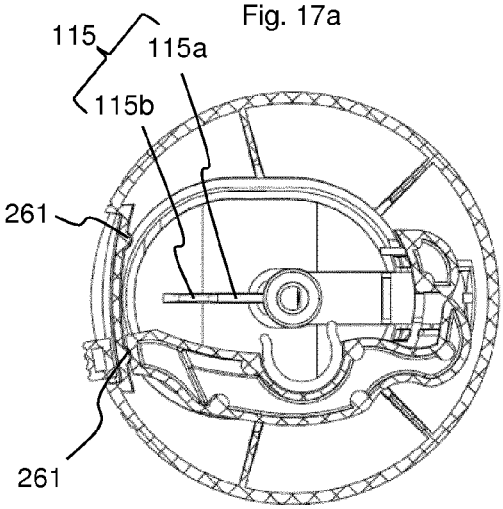
Figure 17B:
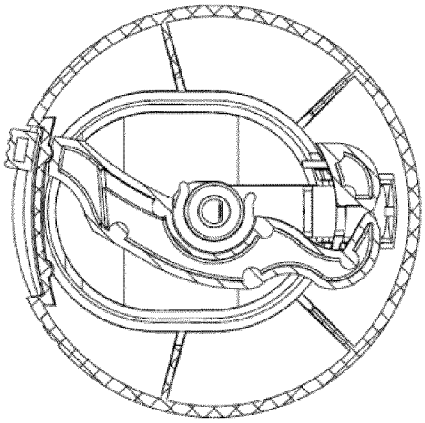
Figure 18A:
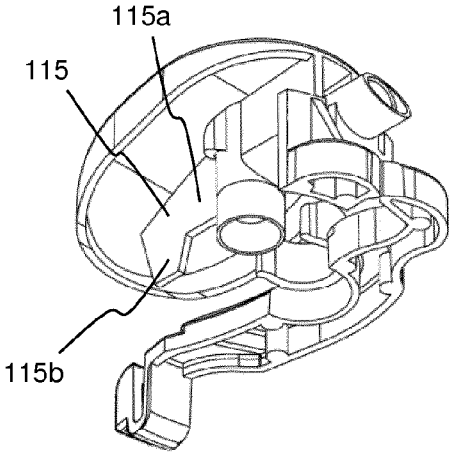
Figure 18B:
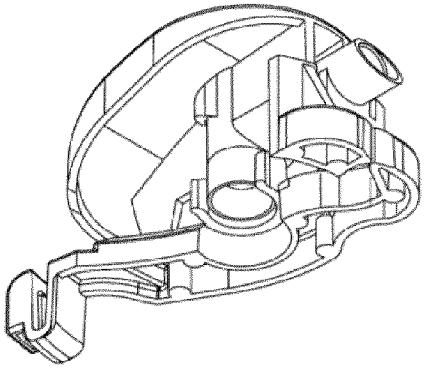
Figure 19A:
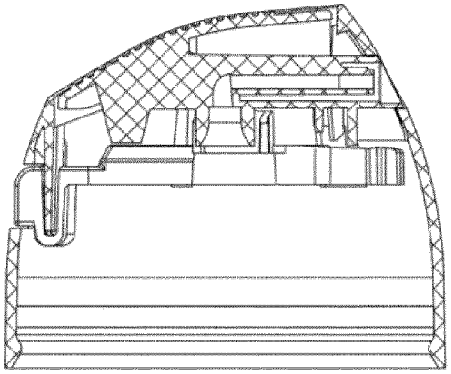

The invention is explained in more detail by way of the following figures:

FIG. 1: an exploded (a) rear and (b) front perspective view of a first embodiment of the dispensing head of the invention in the locked position;

FIG. 2: the actuating member of the dispensing head of FIG. 1 in the position as extracted from the mold;

FIG. 3: the actuating member of the dispensing head of FIG. 1 seen from below (a) in the unlocked position and (b) in the locked position;

FIG. 4: the actuating member of the dispensing head of FIG. 1 seen from the side (a) in the unlocked position and (b) in the locked position;

FIG. 5: the actuating member of the dispensing head of FIG. 1 seen in perspective (a) in the unlocked position and (b) in the locked position;

FIG. 6: the cover of the dispensing head of FIG. 1 seen from behind;

FIG. 7: the cover of the dispensing head of FIG. 1 seen from below;

FIG. 8: the cover of the dispensing head of FIG. 1 seen from the side in cross-section;

FIG. 9: the cover of the dispensing head of FIG. 1 seen from behind in cross-section;

FIG. 10: the dispensing head of FIG. 1 seen from below (a) in the unlocked position and (b) in the locked position;

FIG. 11: the dispensing head of FIG. 1 mounted on an aerosol container (a) in the unlocked position and (b) in the locked position;

FIG. 12: an enlarged schematic view in cross-section of the dispensing head of FIG. 1 in the closed position seen from behind;

FIG. 13: a partial cross-section through the dispensing head of FIG. 1 (*a*) in the unlocked position and (*b*) in the locked position;

FIG. 14: an exploded perspective view, (a) from behind and (b) from the front of a second embodiment of the dispensing head of the invention in the locked position;

FIG. 15: the actuating member of the dispensing head of FIG. 14 seen from below (a) in the unlocked position and (b) in the locked position;

FIG. 16: the actuating member of the dispensing head of FIG. 14 seen in perspective (a) in the unlocked position and (b) in the locked position;

FIG. 17: a cross-sectional view of the dispensing head of FIG. 14 at the pivoting part, seen from below (a) in the unlocked position and (b) in the locked position;

FIG. 18: a perspective view from below of the actuating member of FIG. 14 (*a*) in the unlocked position and (*b*) in the locked position;

FIG. 19: a vertical cross-sectional view of the dispensing head of FIG. 14 (*a*) in the unlocked position and (*b*) in the locked position.

FIGS. 1 to 13 show a first embodiment and FIGS. 14 to 19 show a second embodiment very close to the first embodiment. The same parts have the same references.

The dispensing head is made up of two main parts: an actuating member (1) and a cover (2).

The cover 2 has a general shape of a bombshell and has a vertical axis of symmetry (A1), which is shown schematically by the cross in FIG. 7 and to which the adjectives "radial" and "axial" used hereinafter refer. An opening (21) intended for the passage of a push button (11) of the actuating member is provided at the top of the cover. The edge of the opening may be marked by a vertical flange (211) which is oriented downwards. The cover is provided with an outlet orifice (22) to allow the product exiting from the nozzle of the dispensing head to pass through. The inner face of the cover is provided with a bulge (23) for securing it to the crimped edge of an aerosol bottle. Also on its inside face, the cover is provided with two vertical fastening ribs (24) which are parallel to each other and placed on opposite sides of the outlet orifice (22). They are oriented away from the cover in the direction of the inside. These fastening ribs (24) are each provided with a vertical slot (241) that opens onto the lower edge of the fastening ribs while flaring slightly. In the example shown here, the vertical ribs begin at the inner face of the cover and end near the opening (21).

Opposite the outlet orifice (22), the cover is provided with a horizontal slot (25) located between the bulge (23) and the opening (21). A vertical guide plate (26) is placed inside the cover, facing the horizontal slot (25). It is attached by its upper portion to the inner face of the cover, above the horizontal slot (25), and it extends at least to the lower edge of the slot, or even a little lower. The plate preferably has the shape of a circular arc. A groove is thus formed between the guide plate (26) and the inner wall of the cover at the horizontal slot (25). The length of the guide plate (26) is chosen so that it hides the inside of the cover from the user. In the first embodiment, the guide plate (26) extends to the right and left of the opening (25), while in the second, it has the same size and is connected at its ends to the lateral edges of the opening by walls (251).

The actuating member (1) is essentially made up of a push button (11) and a blocking element (12), these two elements being connected together by a fastening plate (13).

The push button (11) consists essentially of an actuating plate (111) which can have a domed or curved shape and whose peripheral edge can extend downwards by a vertical flange (112). On its lower face, the actuating plate is provided with an outlet conduit for the product to be sprayed. This conduit consists of a first portion (113) and a second portion (114). The first portion (113) is substantially vertical and defines a vertical axis of symmetry (A2) which is marked schematically by a cross in FIG. 2. It should be noted that the push button by itself does not necessarily have rotational symmetry. The free lower end of the first portion (113) of the outlet conduit serves as a connection end-piece for coupling it to the valve dispensing rod. For this purpose, the free end is slightly flared to facilitate assembly of the dispensing head on the dispensing rod of the container. If the dispensing head is intended for a female type valve, the connection end-piece is replaced by a rod for actuating the female valve. The second portion (114) of the outlet conduit can be inclined (for example, perpendicular) relative to the first portion, and is fixed to the actuating plate (111). The free end of the second portion (114) of the outlet conduit ends in a housing for a nozzle. To prevent the push button from coming out of the cover, retaining shoulders can be provided on the lower edge of the flange (112).

The shape of the actuating plate (111) and its flange (112) is complementary to the shape of the opening (21) of the cover and of its optional flange, preferably allowing a clearance between the two to avoid friction. The retaining shoulders (if there are any) extend away from the flange (112) so that when assembled, they cannot pass through the opening (21) and are retained by the latter.

On the lower face of the actuating plate (111), the push button (11) is provided with a blocking rib (115) parallel to the displacement direction of the push button between the rest position and the actuating position. In practice, this direction is substantially vertical.

In the first embodiment, the rib is in the extension of the flange (112), so that it is aligned with the edge of the actuating plate, slightly offset from the plane defined by the two portions (113, 114) of the conduit.

In the second embodiment, this rib is located under the actuating plate, preferably in a radial plane, in particular in the plane defined by the two portions (113, 114) of the conduit. The locking rib (115) is in the shape of an inverted L. The first branch extends along the actuating plate and the second branch protrudes downwards.

The fastening plate (13) has the general shape of an inverted L. This fastening plate is vertical and preferably has the shape of a circular arc, where the center of the circle can be located on the axis of symmetry (A2). The first branch of the L extends horizontally from the lower edge of the second portion (114) of the outlet conduit near its free end. It has, on its vertical lateral edges, two fins (131) directed towards the center of the actuating member. These fins (131) are parallel to each other. The thickness of this first branch is chosen so that, in the assembled state, it can penetrate, preferably by force, into the slots (241) of the fastening ribs (24) of the cover. The distance separating the fins (131) of the fastening plate is greater than or equal to the distance separating the opposite faces of the two fastening ribs (24). The second branch of the L is directed downwards and can terminate in a support (132).

The blocking element (12) is constituted by a pivoting part (121) articulated on the fastening plate (13), preferably on the support (132), by a joint (122). This joint may be in the form of a pin hinge or a film hinge defining a vertical axis of rotation (A3), that is, parallel to the axis (A2) defined by the first portion (113) of the outlet conduit. The pivoting part (121) is provided, at its end opposite from the hinge, with a control element (123). The pivoting part has, just before the control element, an upwardly open groove (124), the width of which is at least equal to the thickness of the guide plate (26) of the cover. It could also be envisioned to place the control element (123) on a vertical plate fastened to the end of the pivoting part (121) so that this plate is placed facing the opening (25) whatever the position of the control element.

In order to hold the blocking element in one of the extreme positions, namely, the locked position or the unlocked position, the guide plate (26) can be provided with retaining studs (261) and the groove (124) can be provided with a corresponding recess on one of its faces, which, in this case, is a slot (124*a*). In addition, to ensure contact between the guide plate (26) and one of the walls of the groove (124), it is preferable to provide on the second face of the groove (124) an extra thickness, for example a stud or a molding (124*b*).

Between the hinge (122) and the control element (123), the pivoting part (121) has a horizontal bearing surface (125). This bearing surface is provided with a notch (126) in the shape of a circular arc.

In the first embodiment, the bearing surface (125) at the notch is placed on the pivoting part (121) so that it is at the same level as (or at a level just below) the lower face of the first portion (113) of the outlet conduit when the push button is in the rest, that is, non-depressed position. In the example shown here, the bearing surface extends from the hinge (122) to the groove (124). The notch (126) is surrounded on the side of the bearing surface (i.e., upwards) by a half-cylinder (127) which is not completely aligned with the notch so that there remains a semicircular shoulder (128) around the notch and inside the half-cylinder. This shoulder is clearly visible in FIGS. 11*b* and 12. It constitutes a blocking surface. The dimensions of the notch are sufficient to allow the valve dispensing rod (311) to pass through, but not the lower end of the first portion (113) of the outlet conduit.

In the second embodiment, the upper face of the bearing surface (125) is provided with a half-cylinder (127) placed around the notch (126), preferably in alignment with it. The dimensions of the notch (126) are sufficient to allow the lower end of the first portion (113) of the conduit to pass through. Thus, there is no blocking shoulder as in the first embodiment. However, the height of the half-cylinder is chosen so that, in the locked position, there is little or no clearance between the upper edge of the half-cylinder (127) and, on the one hand, the lower edge of the first branch (115*a*) of the blocking rib, and on the other hand, the lower edge of the second portion (114) of the conduit. Conversely, in the unlocked position, the top of the half-cylinder (127) is sufficiently out of the way so that it is not in the path of the blocking rib (115) and the second portion (114) of the conduit.

In both embodiments, it is provided that the lower edge of the stop rib (115), more precisely the lower edge of the second branch (115*b*) in the second embodiment, comes to abut against the bearing surface (125) of the blocking element when the latter is in the locked position. The portion of the bearing surface where this contact occurs is placed on the pivoting part (121) so that it is at the same level as (or at a level just below) the lower edge of the blocking rib, more precisely of the second branch (115*b*) in the second embodiment, when the push button is in the rest, that is, non-depressed, position. Conversely, in the unlocked position, the entire bearing surface (125), or at least this contact portion, is sufficiently out of the way so that it is not in the path of the rib.

The two components, namely the cover (2) and the actuating member (1), are assembled to form the dispensing head, before mounting the dispensing head on an aerosol container. For this purpose, the blocking element (12) is folded from its molding position visible in FIG. 2 until the half-cylinder comes to bear against the first portion (113) of the conduit. For this purpose, the blocking element pivots about the hinge (122). The actuating member (1) is inserted in this position from below into the cover (2) until the fastening plate (13) enters the slots (241) of the fastening ribs and the free end of the second portion (114) of the outlet conduit is located facing the orifice (22) of the cover. In this position, the push button (11) is placed in the space defined by the edge of the opening (21), with the actuating plate (111) flush with the said edge. The control element (123) comes to be housed in the groove formed between the cover and the guide plate (26) so that it can move freely therein. It penetrates into the slot (25) of the cover, and can even project slightly out of the cover to be easily grasped from the outside. The guide plate (26) penetrates into the groove (124) of the pivoting part of the blocking element.

The junction between the fastening plate (13) and the second portion (114) of the outlet conduit constitutes a hinge around which the push button (11) can pivot in order to actuate the valve. In the rest position, the push button (11) is in the high position, that is, flush with the edge of the opening (21). It can be depressed by pivoting around its hinge to actuate the valve.

In the assembled state, the blocking member (12) is pivotable about the hinge (122) between a first position, referred to as the locked position, in which the control member (123) abuts against a first lateral end of the slot (25), and a second position, referred to as the unlocked position, in which the control element (123) abuts against the second lateral end of the slot.

In the first embodiment, in the locked position, the semi-circular blocking shoulder (128) is located below the lower end of the first portion (113) of the outlet conduit, the edge of the notch (126) leaving a passage for the dispensing rod of a valve. In addition, the lower end of the locking rib (115) bears or almost bears on the bearing surface (125). By "almost bears", it should be understood that there is a clearance between the bearing surface and the locking rib, where this clearance can even allow the possibility of moving the push button in the direction of the actuating position, but only to a very small extent, so that this displacement is too short to actuate the valve. It is thus not possible to press the push button, because the first portion (113) of the outlet conduit comes to abut directly against the blocking shoulder (128) and the locking rib against the bearing surface. This is the position shown in particular in FIGS. 11*b* and 12. In the unlocked position, the semi-circular blocking shoulder (128) and the bearing surface are sufficiently spaced so that the lower portion of the first portion (113) of the outlet conduit can pass in front of the notch (126) and the locking rib can move down freely. It can thus be understood that, in the unlocked position, the control element (123) is located against the lateral edge of the slot (25) that is on the side of the hinge (122).

Figure 13B:
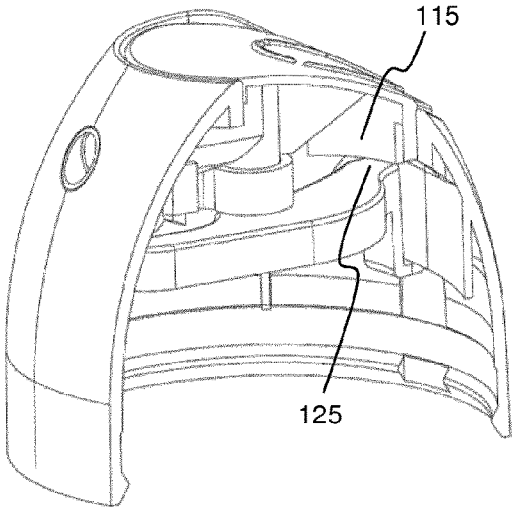
Figure 19B:
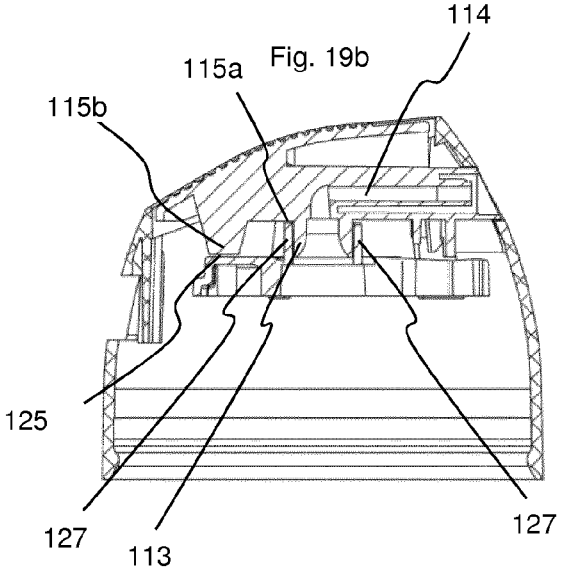

When the blocking element (12) is in the locked position, the push button (11) is blocked in several places. In the first embodiment, this blocking occurs, on the one hand, at the contact between the lower end of the first portion (113) of the conduit and the blocking shoulder (128), as shown in FIGS. 11*b* and 12, and on the other hand, at the contact between the lower edge of the locking rib (115) and the bearing surface (125) near the control element (123), as shown in FIG. 1*a* and FIG. 13*b*. In the second embodiment, there is contact, on the one hand, between the upper edge of the half-cylinder (127) and, on one side, the lower edge of the first branch (115*a*) of the blocking rib, and on the other side, the lower edge of the second portion (114) of the conduit, and, on the other hand, between the lower edge of the second branch (115*b*) of the blocking rib and the bearing surface (125), as shown in FIG. 19*b*.

Conversely, when the blocking element (12) is in the unlocked position, the half-cylinder (127) is sufficiently spaced to no longer interact with the lower edge of the first conduit portion (113), as shown in FIG. 5*a*, for example, or with the lower edge of the first branch (115*a*) of the blocking rib and the lower edge of the second conduit portion (114), as shown in FIG. 17*a*, for example. Similarly, the bearing surface (125) is sufficiently spaced from the blocking rib (115), more precisely from the second branch (115*b*) of the blocking rib in the second embodiment, so that it is not in the path of this rib during the displacement of the push button (11) toward the valve.

The actuating member bears against the valve cup, on the one hand, at the hinge (122), and on the other hand, at the lower face of the pivoting portion (121) between the notch (126) and the groove (124). Further, in the locked position, it bears against the dome of the cup thanks to a second half-cylinder coaxial with the first (127) and located on the lower face of the pivoting portion (121), or at a lower wall.

It is possible to dimension the half-cylinder (127) so that its ends extend beyond the 180° arc so that the inlet slot thus formed is slightly narrower than the diameter of the lower end of the first portion (113) of the conduit. Thus, it is possible, in the locked position, to snap the half-cylinder (127) of the pivoting portion onto the lower end of the first conduit portion (113). However, the ends are sufficiently flexible so that only a slight effort is required to take the conduit out of the half-cylinder. This constitutes, along with the retaining studs (261) of the guide plate (26) and the corresponding slot (124*a*) of the groove (24), means for retaining the pivoting part (121) in the locked position. In this case, the term half-cylinder must be understood in a broader sense than as a cylinder having an angular development equal to 180°.

Although the blocking member may be a separate part attached to the push button by a pin hinge, it is also possible to mold the entire actuating member in one piece. In this case, the blocking element is molded in a position spaced apart, for example, by between 45° and 90°, from its normal position (locked/unlocked), in order to give access to the bottom of the push button. This is the position shown in FIG. 2. Thus, the dispensing head consists of only two parts.

Figure 11A:
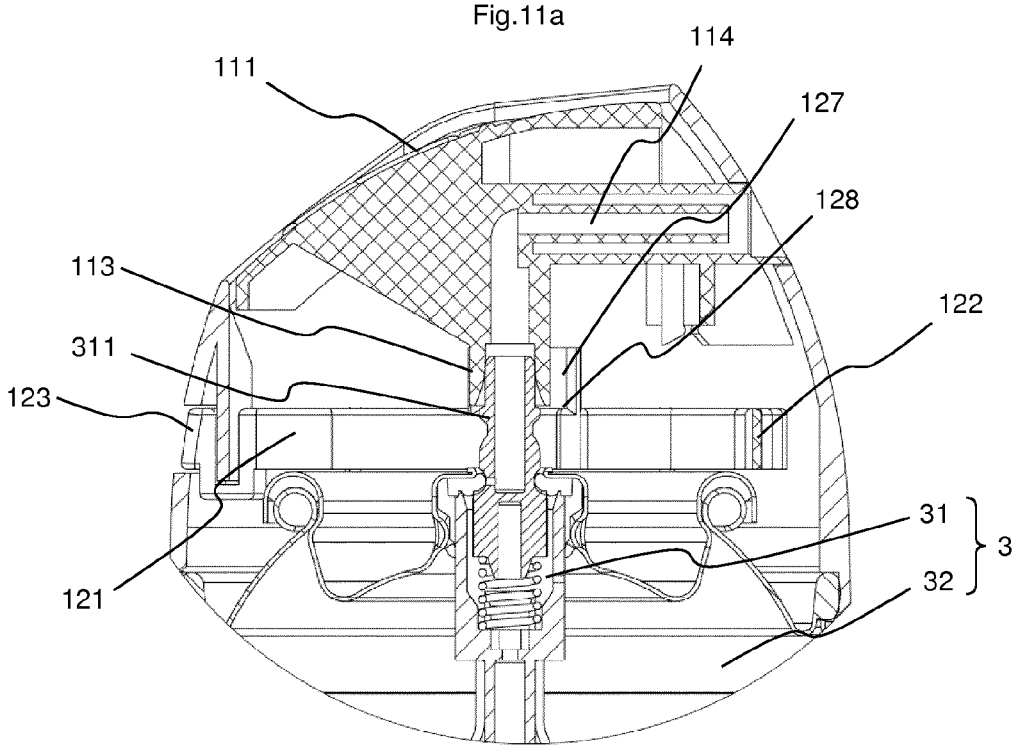
Figure 11B:
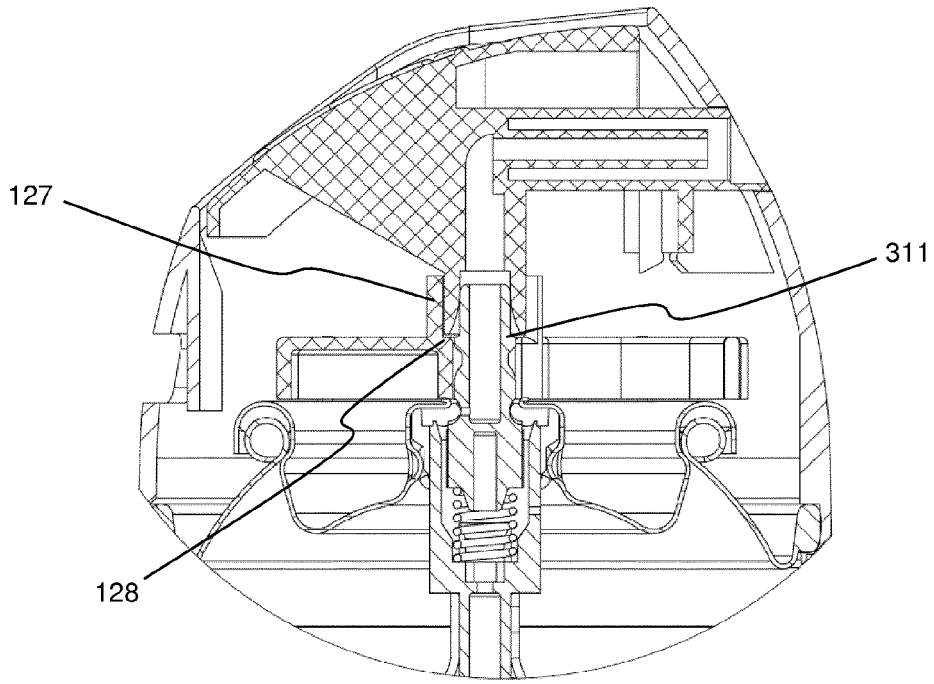

FIGS. 11*a* and 11*b* show the dispensing head (1) of the invention mounted on an aerosol container (3) provided with a male valve (31). The end-piece located at the lower end of the first portion (113) of the conduit is fitted onto the stem (311) of the valve. The cover is fixed to the container (3) by its bulge (23) engaged behind a shoulder of the housing (32).

The exemplary embodiments show dispensing heads with two blocking means. It is self-evident that it would be possible to provide only a blocking shoulder (128), only a rib bearing on the bearing surface (125), or only a rib bearing on the half-cylinder, or even only an abutment of the second channel portion against the top of the half-cylinder.

LIST OF REFERENCES

1 Actuating member
- 11 Push button
  - 111 Actuating plate
  - 112 Vertical flange
  - 113 First portion of the outlet conduit
  - 114 Second portion of the outlet conduit
  - 115 Blocking rib
    - 115*a* First branch
    - 115*b* Second branch
- 12 Blocking element
  - 121 Pivoting part
  - 122 Hinge
  - 123 Control element
  - 124 Groove
    - 124*a* Recess (slot)
    - 124*b* Over-thickness
  - 125 Bearing surface
  - 126 Notch
  - 127 Half-cylinder
  - 128 Blocking shoulder
- 13 Fastening plate
  - 131 Fins
  - 132 Support for the blocking element

2 Cover
- 21 Opening
  - 211 Flange of opening
- 22 Outlet orifice for the passage out of the nozzle
- 23 Bulge
- 24 Vertical fastening ribs
  - 241 Vertical slots
- 25 Horizontal slot
  - 251 Side walls of the slot
- 26 Guide plate
  - 261 Retaining studs

3 Aerosol container
- 31 Valve
  - 311 Dispensing rod of the valve (stem)
- 32 Housing

A1 Axis of symmetry of the cover
A2 Axis of symmetry of the conduit
A3 Axis of rotation of the pivoting part

The invention claimed is:

1. A dispensing head for an aerosol container provided with a valve, said dispensing head comprising:

a cover, and an actuating member fastened to the cover, wherein the actuating member is provided with a push button which can be moved between a non-depressed rest position and a depressed actuating position, wherein the push button is provided with an outlet conduit for a product to be removed, a first portion of the outlet conduit having a first end provided with a connection intended to cooperate with a valve of an aerosol container and a second portion of the outlet conduit having a second end being intended to spray the product into the environment, wherein the actuating member is provided with a blocking element which is pivotable about an axis of rotation between an unlocked position in which the blocking element does not block the movement of the push button relative to the cover and a locked position in which the blocking element blocks the push button in the rest position by preventing the push button from going into the actuating position, and wherein the axis of rotation of the blocking element is located at a distance from and parallel to an axis of the first portion of the outlet conduit.

2. The dispensing head according to claim 1, wherein, in the locked position, the blocking element cooperates with a blocking portion of the first end of the outlet conduit.

3. The dispensing head according to claim 2, wherein the connection comprises an end-piece designed to cooperate with a stem of a male valve, the blocking element acting on a free end of the end-piece in the locked position.

4. The dispensing head according to claim 2, wherein the connection comprises a rod adapted to cooperate with a female valve, the first end of the outlet conduit being provided, on an outer face of the first end, with a shoulder designed so that the blocking element acts on the shoulder in the locked position.

5. The dispensing head according to claim 1, wherein
- the push button is provided with a rib parallel to a displacement movement of the push button between the rest position and the actuating position;
- the blocking element is provided with a bearing surface which, in the unlocked position, is not in a path followed by the rib when the push button is moved from the rest position to the actuating position, and which, in the locked position, is in the path so that the rib comes to abut against the bearing surface when the push button is moved toward the actuating position, without being able to reach this position.

6. The dispensing head according to claim 5, wherein the rib is placed on an inner face of the push button.

7. The dispensing head according to claim 5, wherein the rib is placed in alignment with an edge of the push button.

8. The dispensing head according to claim 1, wherein
- a pivoting portion of the blocking element has a notch surrounded by a cylinder portion oriented toward the push button, and
- the push button has, on a lower face of the push button, a blocking rib parallel to a displacement movement of the push button between the rest position and the actuating position,
- wherein a height of the cylinder portion is selected so that, in the locked position, an upper edge of the cylinder portion is in contact or almost in contact with a lower edge of the blocking rib so that the push button cannot go from the rest position to the actuating position.

9. The dispensing head according to claim 1 intended for actuating a valve by means of a rod, wherein
- the blocking element comprises a pivoting portion articulated on the actuating member by a joint, and
- the pivoting portion is provided with
  - a control element accessible from outside the cover, and
  - a blocking surface provided with a notch in the shape of a circular arc, whose dimensions are sufficient to allow the rod that serves for actuating the valve to pass through, but not a blocking portion of the first end of the outlet conduit, wherein the blocking portion cooperates with the blocking surface in the locked position.

10. The dispensing head according to claim 1, wherein the blocking surface of the blocking element is surrounded by a cylinder portion dimensioned so that the pivoting portion cannot pivot beyond the locked position.

11. The dispensing head according to claim 9, wherein the cover is provided with a slot facing which the control element is located whatever the pivoting position of the pivoting portion between the unlocked position and the locked position, the control element being accessible from the outside through said slot.

12. The dispensing head according to claim 11, wherein a plate is provided facing the slot to hide the inside of the cover from the user.

13. The dispensing head according to claim 12, wherein the plate is placed in the cover and the pivoting portion is provided with a groove whose width is at least equal to the thickness of the plate and in which the free end of the plate is placed.

14. The dispensing head according to claim 12, wherein the plate is arranged on the pivoting portion, between the groove and the control element, so that the plate is placed facing the opening whatever the pivoting position of the pivoting portion.

15. The dispensing head according to claim 5, wherein the rib is placed on an inner face of the push button (11), radially relative to the axis of rotation.

16. The dispensing head according to claim 2, wherein
- the push button is provided with a rib parallel to a displacement movement of the push button between the rest position and the actuating position;
- the blocking element is provided with a bearing surface which, in the unlocked position, is not in a path followed by the rib when the push button is moved from the rest position to the actuating position, and which, in the locked position, is in the path so that the rib comes to abut against the bearing surface when the push button is moved toward the actuating position, without being able to reach this position.

17. The dispensing head according to claim 16, wherein the rib is placed on an inner face of the push button.

18. The dispensing head according to claim 16, wherein the rib is placed in alignment with an edge of the push button.

19. The dispensing head according to claim 2, wherein
- a pivoting portion of the blocking element has a notch surrounded by a cylinder portion oriented toward the push button, and
- the push button has, on a lower face of the push button, a blocking rib parallel to a displacement movement of the push button between the rest position and the actuating position,
- wherein a height of the cylinder portion is selected so that, in the locked position, an upper edge of the cylinder portion is in contact or almost in contact with a lower edge of the blocking rib so that the push button cannot go from the rest position to the actuating position.

20. The dispensing head according to claim 2 intended for actuating a valve by means of a rod, wherein
- the blocking element comprises a pivoting portion articulated on the actuating member by a joint, and
- the pivoting portion is provided with
  - a control element accessible from outside the cover, and
  - a blocking surface provided with a notch in the shape of a circular arc, whose dimensions are sufficient to allow the rod that serves for actuating the valve to pass through, but not a blocking portion of the first end of the outlet conduit, wherein the blocking portion cooperates with the blocking surface in the locked position.

21. A dispensing head for an aerosol container provided with a valve, said dispensing head being intended for actuating a valve by means of a rod and comprising:
- a cover, and
- an actuating member fastened to the cover, wherein the actuating member is provided with a push button which can be moved between a non-depressed rest position and a depressed actuating position,
- wherein the actuating member is provided with a blocking element which is pivotable about an axis of rotation between an unlocked position in which the blocking element does not block the movement of the push button relative to the cover and a locked position in which the blocking element blocks the push button in the rest position by preventing the push button from going into the actuating position, wherein the blocking element comprises a pivoting portion articulated on the actuating member by a joint, wherein the pivoting portion is provided with a blocking surface provided with a notch in the shape of a circular arc, whose dimensions are sufficient to allow the rod that serves for actuating the valve to pass through, and wherein the blocking surface blocks the push button in the rest position by preventing the push button from going into the actuating position.

22. The dispensing head according to claim 21, wherein the axis of rotation of the blocking element is located at a distance from and parallel to an axis of the rod.

23. The dispensing head according to claim 21, wherein the pivoting portion is provided with a control element accessible from outside the cover.

* * * * *